US006925890B2

(12) United States Patent
Fontenot

(10) Patent No.: US 6,925,890 B2
(45) Date of Patent: Aug. 9, 2005

(54) ANCHOR CHAIN LOAD MEASUREMENT ARRANGEMENT

(75) Inventor: William L. Fontenot, Houston, TX (US)

(73) Assignee: FMC Technologies, Inc., Chicago, IL (US)

( * ) Notice: Subject to any disclaimer, the term of this patent is extended or adjusted under 35 U.S.C. 154(b) by 149 days.

(21) Appl. No.: 10/365,937

(22) Filed: Feb. 13, 2003

(65) Prior Publication Data

US 2003/0155564 A1 Aug. 21, 2003

Related U.S. Application Data

(60) Provisional application No. 60/357,283, filed on Feb. 15, 2002.

(51) Int. Cl.[7] ..... G01N 3/08

(52) U.S. Cl. ..... 73/828; 73/796; 254/358

(58) Field of Search ..... 73/796, 826–830, 73/788, 818, 854; 254/266, 358

(56) References Cited

U.S. PATENT DOCUMENTS 4,094,141 A * 6/1978 Rehbein ..... 59/93
4,425,056 A 1/1984 Hunter
4,495,824 A 1/1985 Dantan
4,825,069 A 4/1989 Benoit
5,703,553 A 12/1997 Avakian et al.
5,745,042 A * 4/1998 Pratt ..... 340/657
5,783,755 A * 7/1998 Bruns ..... 73/862.541
5,845,893 A 12/1998 Groves ..... 254/389
5,925,832 A * 7/1999 Bruns ..... 73/862.635
6,088,106 A 7/2000 Rockseisen
6,232,566 B1 * 5/2001 Bruns ..... 73/113

* cited by examiner

*Primary Examiner*—Max Noori
*Assistant Examiner*—Alandra Ellington
(74) *Attorney, Agent, or Firm*—Gary L. Bush; Andrews Kurth LLP

(57) ABSTRACT

Anchor chain load measurement arrangement for measuring the reactive load in structures which support an anchor chain. In one arrangement, standard resistance compression load cells are mounted directly in the load path between a chain retainer and a trunnion block. In another arrangement a non-contact sensor is positioned to measure the deflection of an inner portion of the trunnion block with respect to a supported outer portion of the trunnion block. The non-contact sensor can be based on capacitive, eddy current or optical measurement principles.

9 Claims, 2 Drawing Sheets

10A
10
14
17
15
15
16
12
S
S
F 10
14
28
28
26
21
21
20
20
30
30
22
22
24
24
26
12
S
S
F

ANCHOR CHAIN LOAD MEASUREMENT ARRANGEMENT

CROSS REFERENCE TO RELATED APPLICATION

This application is based upon provisional application No. 60/357,283 filed on Feb. 15, 2002, the priority of which is claimed.

BACKGROUND OF THE INVENTION

1. Field of the Invention

This invention concerns measurement of loads in an anchor chain.

2. Description of the Prior Art

Prior art methods for measuring loads in anchor chains have included placing load cells directly on a chain link to measure load in the chain when mooring an offshore structure such as an offshore platform or vessel. U.S. Pat. No. 5,845,893 discloses an extensiometer mounted on a latch housing to measure chain force in an anchor chain when it is held by a latch mechanism.

Identification of Objects of the Invention

A primary object of the invention is to provide a force measuring arrangement in the support load path for the measurement of anchor chain load.

Another object of the invention is to provide an arrangement for measuring the compressive force between an anchor chain retainer and a support arm.

Another object of the invention is to provide an arrangement for indirectly measuring the anchor chain load by measuring the deflection of an inner portion of a support arm with respect to the position of an outer portion of a support arm which reacts the chain load.

SUMMARY OF THE INVENTION

The objects identified above along with other features and advantages are incorporated in an arrangement for measuring the load of an anchor chain by measuring the reactive load in structures which support the chain. In a first embodiment, contacting load cells are placed between a chain retainer and arms of a trunnion block for directly measuring the load of the chain. In a second embodiment non-contracting sensors are provided for measuring deflection of inner portions of the trunnion arms with respect to fixed portions of the trunnion arms as an indicator of the chain load transferred to the trunnion arms.

DESCRIPTION OF THE PREFERRED EMBODIMENTS

Figure 1:
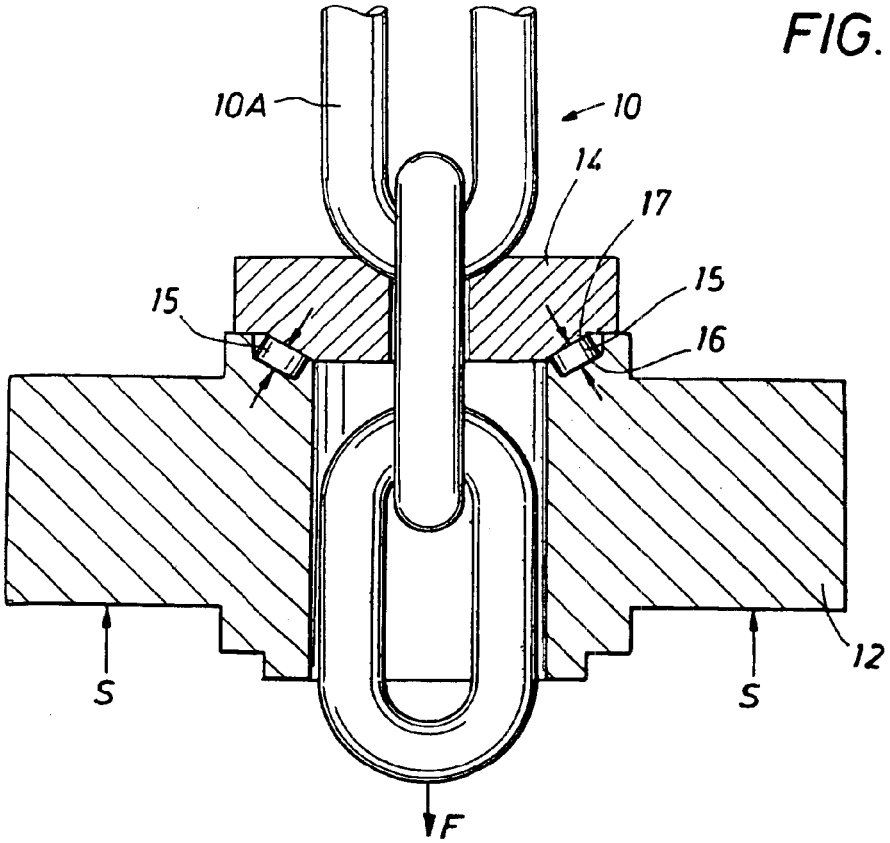
FIG. 1 shows resistance compression load cells mounted directly in the load path between the chain retainer and the trunnion block.

FIG. 1 illustrates a first embodiment of the invention for measuring the load in an anchor chain. The load F in the anchor chain 10 is reacted by chain retainer 14 on link 10A. Load cells 15 placed between abutting surfaces 16, 17 are compressed by the load between chain retainer 14 and trunnion block 12. The trunnion block 12 is supported on an offshore structure at spaced positions indicated by the arrows S. Because the downward force on trunnion block 12 caused by the weight of the chain retainer 14 is known, the downward force F caused by the weight of the chain 10 and retaining force placed on it is determinable from the measurement of the load cells 15. Load cells appropriate for the arrangement of FIG. 1 are commercially available from Scientific Marine Services, Inc. The load cells include electrical leads (not shown) for communication to a remote signal panel.

Figure 2:
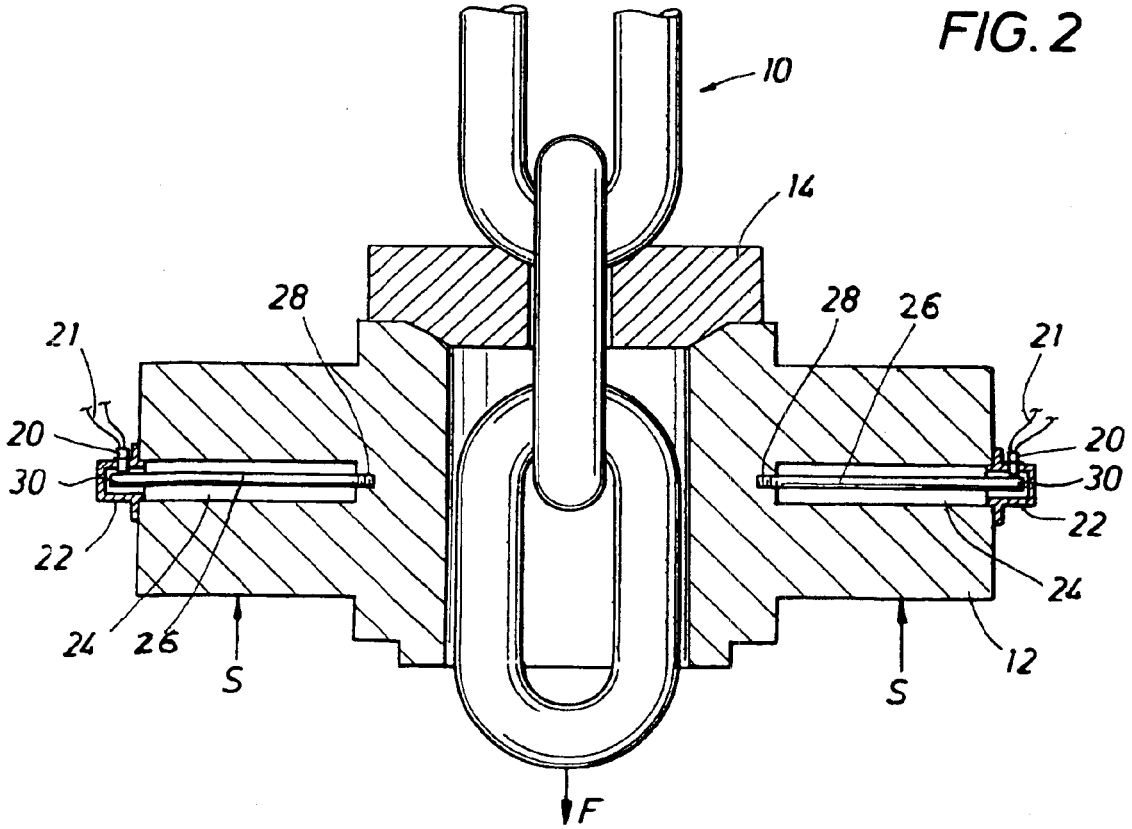
FIG. 2 shows non-contact sensors on ends of the trunnion block which measure the relative deflection between an indicator rod attached to the center section of the trunnion block and a non-contact sensor mounted to the end of the trunnion.

FIG. 2 illustrates a second embodiment of the invention where non-contact sensors 20 are mounted in housings 22 which are mounted at the exterior opening of slots 24 formed in trunnion block walls. Indicator rods 26 are fixed at an inner end 28 to the wall of the trunnion block 12 and extend to an outer end 30 placed within the sensor housing 22. The outer ends 30 are free to move within sensor housing 22 when the inner end 28 deflects a short distance when load F is reacted by chain retainer 14 and trunnion block 12. The inner end deflects, because the effective load path through trunnion blocks 12 is inwardly of supports S. The sensors 20 can be any device that senses the deflection of one member (e.g. the end 30 of rod 24) with respect to another (e.g. the sensor housing 22). Such sensors 20 can alternatively be based on capacitive, or eddy current, or optical measurements. Example commercially available sensors are Accumeasure System 1500 Capacitive Gauging System, MTI 2000 Fotonic Sensor or Microtrak 7000 Laser Dispacement Sensor, which are manufactured by MTI Instruments, Inc. and SUNX GP-A Eddy Current Displacement Sensors from Matsushita Electric Works UK. Electrical leads 21 provide communication to sensors 20.

Figure 3:
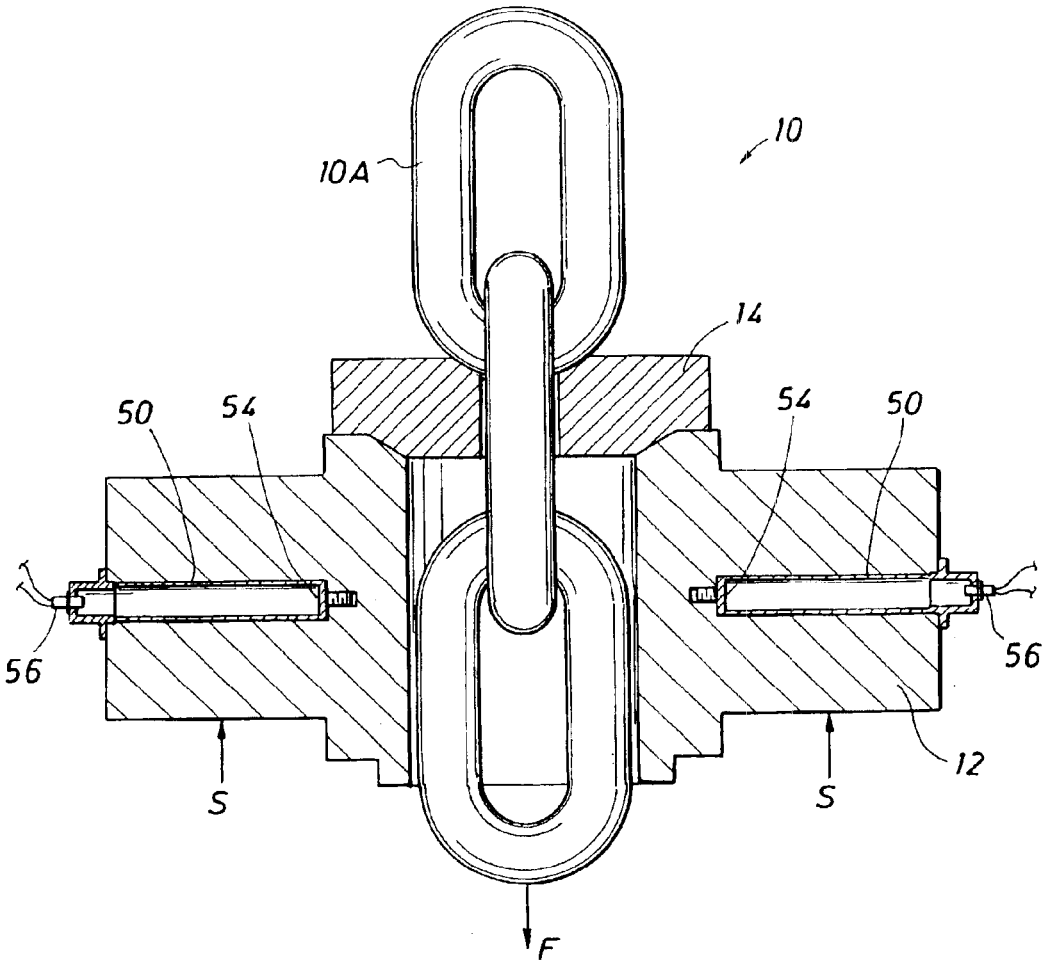
FIGS. 3 and 4 show an optical sensor where an optical beam is emitted from the sensor toward a reflective target, such that if the sensor housing is under load, the target rotates causing the beam to be reflected back to the sensor at an angle where the measurement of that angle is a measure of the load in the trunnion housing.
Figure 4:
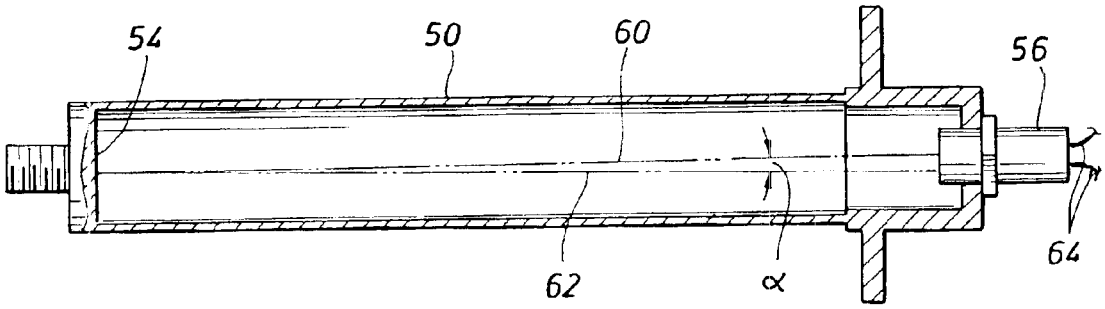

FIGS. 3 and 4 illustrate another alternative arrangement for measuring the load F on chain 10 that uses a laser-based triangulation distance measurement system to measure target rotation. Sensor housings 50 are installed in the trunnion block arms 12. A laser displacement sensor 56 is mounted at the outer end of the housing 50, and a reflective target 54 is placed at the inner end of the housing 50. As load of chain 10 is reacted by the chain retainer 14 and the trunnion block 12, the inner portion of the trunnion blocks deflects or rotates a small distance with respect to the outer end at supports S. FIG. 4 shows the operation of laser displacement sensor 56 that produces a sending light beam 60 toward target 54. Target 54 reflects the beam 62 toward the sensor 56. As illustrated, if the reflective target has been rotated as a result of chain load, the returning beam 62 is reflected at a new angle $\alpha$ with respect to the sending light beam. The sensor 56 measures the angle change. A conversion of that angle information into chain load information is made remotely. An example of a commercially available sensor is the Microtrak 7000 Laser Dispacement Sensor manufactured by MTI Instruments, Inc. Electrical leads 64 to sensor 56 connect to a processing unit (not shown) for data collection and processing.

What is claimed is:

1. A load measuring arrangement comprising, a chain retainer (14) having a retainer load surface (17), a trunnion block (12) having a trunnion load surface (16), a chain (10) having a link (10A) retained by said chain retainer, and a load cell arranged and designed for measuring compression load and placed between said retainer load surface (17) and said trunnion load surface (16).

2. An arrangement for measuring anchor chain load comprising, support arms (12) having radially outward and radially inward ends, said support arms having a chain passage therein, said support arms (12) having fixed supports (S) at radially outward positions, a chain retainer (14) mounted on radially inward positions of said support arms (12), a chain (10) disposed partially in said chain passage and carried by said chain retainer (14) with chain load being transferred to said chain retainer (14) and said support arms (12) and reacted by said support arm (12) at said radially outward positions, a radially oriented slot (24) in at least one of said arms (12) which extends from said radially outward end to an inner position which is radially inward of said fixed support (S), a rod (26) positioned in said slot and having a fixed end (28) fixed to said inner position of said slot and having a free end (30), and a sensor (20) mounted on said support arms (12) that measures movement of said free outer end (30) of said rod with respect to said radially outward position of said support arm as an indication of chain load.

3. The arrangement of claim 2 wherein, said sensor (20) is a capacitive based sensor.

4. The arrangement of claim 2 wherein, said sensor is an eddy-current based sensor.

5. The arrangement of claim 2 wherein, said sensor is an optical based sensor.

6. The arrangement of claim 2 wherein, said sensor is a laser triangulation based sensor.

7. An arrangement for measuring anchor chain load comprising, support arms (12) having radially outward and radially inward portions, each of said support arms (12) having a fixed support (S) at a radially outward position, a chain retainer (14) mounted on radially inward positions of said support arms (12), a chain (10) carried by said chain retainer (14), with chain load being transferred to said chain retainer (14) and said support arms (12) and reacted by said support arms (12) at said radially outward positions, a radially oriented slot (24) in at least one of said arms (12) which extends from a radially outward end to an inner position which is radially inward of said fixed support (S), a reflective target (54) positioned at said inner position of said slot; and a light sensor (56) apparatus mounted on said radially outward end of said support arm (12) which emits a sending light beam (60) toward said reflective target (54), senses a reflected beam (62) from said reflective target (54), and measures an angle between said sending light beam (60) and said reflected light beam (62) as an indicator of chain load.

8. An arrangement for measuring anchor chain load comprising, support arms (12) having radially outward and radially inward portions, said support arms having a chain passage therein, each of said support arms (12) having a fixed support (S) at a radially outward position, a chain retainer (14) mounted on radially inward positions of said support arms (12), a chain (10) disposed partially in said chain passage and carried by said chain retainer (14), with chain load being transferred to said chain retainer (14) and said support arms (12) and reacted by said support aims (12) at said radially outward positions, a sensor (20, 56) mounted on at least one of said support arms (12) which measures deflection of a radially inward portion of said support arm relative to said radially outward end of said support portion as an indicator of chain load.

9. The arrangement of claim 8 wherein, a sensor (20,56) is mounted on both of said support arms (12), each sensor arranged and designed to measure deflection of a radially inward portion of a respective support arm relative to a radially outward end of said support portion as an indicator of chain load.

* * * * *

UNITED STATES PATENT AND TRADEMARK OFFICE

CERTIFICATE OF CORRECTION

PATENT NO. : 6,925,890 B2
DATED : August 9, 2005
INVENTOR(S) : William L. Fontenot It is certified that error appears in the above-identified patent and that said Letters Patent is hereby corrected as shown below:

Column 4,
Line 31, delete the words "aims" and insert the word -- arms --.

Signed and Sealed this

Eighteenth Day of October, 2005

JON W. DUDAS
*Director of the United States Patent and Trademark Office*